313-414 SR

1/25/83 XR 4,370,594

United States Patent [19]

Kuzenetzoff

[11] 4,370,594

[45] Jan. 25, 1983

[54] RESISTIVE LENS STRUCTURE FOR ELECTRON GUN

[75] Inventor: Philip Kuzenetzoff, Bridgewater, N.J.

[73] Assignee: RCA Corporation, New York, N.Y.

[21] Appl. No.: 964,539

[22] Filed: Nov. 29, 1978

[51] Int. Cl.[3] ..... H01J 29/56; H01J 29/48; H01J 29/82

[52] U.S. Cl. ..... 313/458; 313/460; 313/414

[58] Field of Search ..... 313/460, 458, 414, 411, 313/450; 315/3 (U.S. only)

[56] References Cited

U.S. PATENT DOCUMENTS

| | | | |
|---|---|---|---|
| 2,143,390 | 1/1939 | Schroter | 313/449 |
| 2,291,462 | 7/1942 | Gardner | 313/458 |
| 2,313,018 | 3/1943 | Krause | 313/458 |
| 2,714,679 | 8/1955 | De Graaff et al. | 313/450 |
| 3,458,745 | 7/1969 | Shoulders | 313/105 CM X |
| 3,932,786 | 1/1976 | Campbell | 313/414 X |
| 4,010,312 | 3/1977 | Pinch et al. | 428/450 |
| 4,091,144 | 5/1978 | Dresner et al. | 428/328 |

FOREIGN PATENT DOCUMENTS

| | | | |
|---|---|---|---|
| 1273703 | 7/1968 | Fed. Rep. of Germany | 313/450 |

*Primary Examiner*—Robert Segal

*Attorney, Agent, or Firm*—Eugene M. Whitacre; Glenn H. Bruestle; Vincent J. Coughlin, Jr.

[57] ABSTRACT

An electron gun includes two electrodes between which a resistive lens structure is mounted. The lens structure comprises a stack of alternate apertured electrode plates and insulator spacer blocks. A high resistance coating of, e.g., cermet or glaze material, is disposed along one side of the stack so that it contacts a side of each spacer block and an edge of each apertured electrode plate.

8 Claims, 5 Drawing Figures

RESISTIVE LENS STRUCTURE FOR ELECTRON GUN

BACKGROUND OF THE INVENTION

This invention relates to electron guns, and especially to electron guns for use in television picture tubes. The invention is particularly directed to electron lenses for such guns, and more particularly to long focal length lenses (extended lenses) of the resistive type.

One of the characteristics which measure the quality of an electron lens is its degree of freedom from spherical aberration. In the presence of spherical aberration, all electrons emanating from an object point do not, after focusing, recombine at a common image point.

Spherical aberration can be reduced by using an electron lens having a long focal length. Long focal length lenses are characterized by weak focus fields having slightly, rather than sharply, curved field lines which are established over a longer path of beam travel. Accordingly, such lenses are also referred to as extended lenses because the lensing action is "stretched out" or "extended" over a longer distance. The weak fields of such lenses subject an electron beam passing therethrough to a gentle, gradual bending of its rays, thereby avoiding severe spherical aberration.

It is well known that the focal length of a lens can be lengthened by increasing the size of the lens aperture and/or the gap between two electrodes on the lens. However, increasing the diameter of the lens conflicts with the desire to dispose the electron gun in a small neck of a cathode ray tube in order to minimize required deflection power. On the other hand, if the gap between the electrodes is made too large, other electric fields external to the lens penetrate the gap and distort the focus field.

The prior art has disclosed various extended lens structures designed to achieve longer focal length without the attendant disadvantages described above. One type of extended lens is exemplified by the following three representative patents:

| U.S. Pat. No. | Inventor | Issue Date |
|---|---|---|
| 3,863,091 | Hurakawa et al | January 28, 1975 |
| 3,895,253 | Scwartz et al | July 15, 1976 |
| 3,995,194 | Blacker et al | November 30, 1976 |

In lenses as disclosed in these three patents, the lensing action is extended over a longer distance of beam travel by the inclusion of additional electrodes to which different voltages are applied. In such guns, it has been the practice to provide a separate lead-in for each of the different voltages. The increased lead-in requirement therefore becomes a significant disadvantage to this type of lens.

Another type of extended lens is exemplified by the following two representative patents:

| U.S. Pat. No. | Inventor | Issue Date |
|---|---|---|
| 2,143,390 | Schroter | January 10, 1939 |
| 2,291,462 | Gardner | July 28, 1952 |

In the electron lenses of FIG. 3 of Schroter and of the Gardner patent, a tubular member of resistive material is provided, and a continuous voltage gradient is established along the member by the application of two different potentials to its two ends. This type of lens suffers from the disadvantage of an unavailability of suitable materials from which to make the resistive member and/or unavailable state of art technology for fabricating the member.

A third class of extended lens is exemplified by FIG. 1 of the Schroter patent and by U.S. Pat. No. 3,932,786 issued to F. J. Campbell, on Jan. 13, 1976. In this type of lens, a plurality of metal electrode plates are arranged in serial fashion and a voltage gradient is established along the lens by applying different voltages to the different plates. In order to minimize the number of required lead-ins, a resistive element is provided within the vacuum envelope of the electron tube itself. Although Schroter shows this resistor only schematically, Campbell discloses a practical embodiment of a bleeder resistor disposed on an insulator element of the electron gun structure. Nevertheless, in practice the Campbell structure has proved to have attendant problems of stray emission because of the many connectors required to make contact between the series of apertured electrodes and the bleeder resistor.

Of the extended lenses described above, the Schroter, Gardner, and Campbell structures can be classified as resistive lenses. This is because these three structures incorporate a resistive element within the vacuum enclosure of the electron tube itself, so that only two lead-ins are required to provide a voltage gradient along the length of the lens.

SUMMARY OF THE INVENTION

A resistive type extended electron lens comprises a plurality of apertured electrodes and a plurality of resistive spacer blocks. The electrodes and the blocks are alternately stacked and secured together to form an integral structure such that each resistive block provides an electrical resistive connection between the two adjacent electrodes secured thereto. The resistive blocks may comprise insulator blocks which after being assembled into an integral unitary stack with the apertured electrode plates, are coated along one composite surface of the stack with a suitable resistive material. The resistive material may, for example, be a cermet as disclosed in U.S. Pat. No. 4,010,312 issued to Pinch et al on Mar. 1, 1977; or a glaze as disclosed in U.S. Pat. No. 4,091,144 issued to Dresner et al on May 23, 1978.

DETAILED DESCRIPTION OF THE PREFERRED EMBODIMENT

The present invention is shown as embodied in a 3-beam in-line electron gun of the type described in U.S. Pat. No. 3,772,554, issued to R. H. Hughes on Nov. 12, 1973. The Hughes patent is incorporated by reference herein for the purpose of disclosure. The invention may however be used in other types of electron guns.

Figure 1:
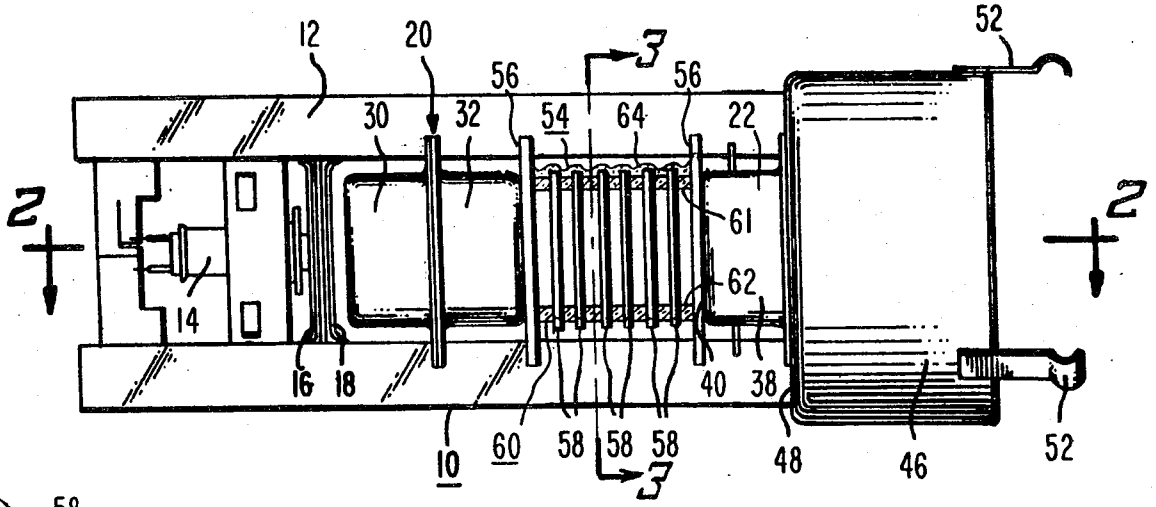
FIG. 1 is an elevation view of the novel electron gun with parts broken away and shown in section.
Figure 2:
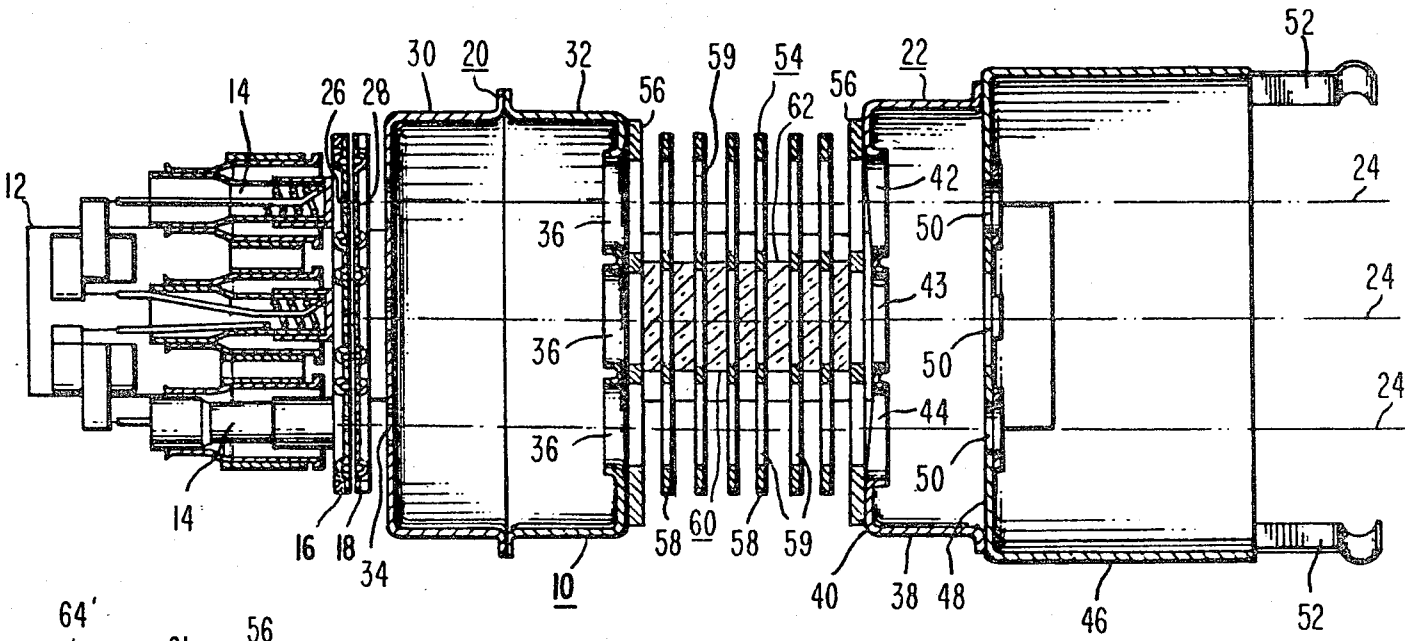
FIG. 2 is a longitudinal section view of the novel electron gun taken along line 2—2 of FIG. 1.

As shown in FIGS. 1 and 2 an electron gun 10 comprises two parallel glass support rods 12 on which various electron gun elements are mounted. At one end of the support rods 12 are mounted three cup-shaped cathodes 14 having emissive surfaces on their end walls. Mounted in spaced relation beyond the cathodes 14 are a control grid electrode 16, a screen electrode 18, a first accelerating and focusing electrode 20 and a second accelerating and focusing electrode 22. The three cathodes 14 project electron beams along three coplanar beam paths 24 through apertures in the electrodes.

The control grid electrode 16 and the screen grid electrode 18 comprise substantially flat metal members each containing three apertures 26 and 28 respectively which are aligned with the beam paths 24.

The first accelerating and focusing electrode 20 comprises two somewhat rectangularly shaped cups 30 and 32 joined at their open ends. The closed ends of the cups 30 and 32 each have three apertures 34 and 36 respectively such that each aperture is aligned with a separate beam path 24.

The second accelerating and focusing electrode 22 comprises a somewhat rectangular cup 38 having a base 40. The base 40 faces toward the first accelerating and focusing electrode 20 and has three apertures 42, 43 and 44 therein. The center aperture 43 is aligned with the center aperture 36 of the first accelerating and focusing electrode 20. The two outer apertures 42 and 44 are slightly offset outwardly with respect to the corresponding outer apertures 36 of the first accelerating and focusing electrode 20.

A shield cup 46 having a base 48 is attached to the second accelerating and focusing electrode 22 so that the base covers the open end of the second accelerating and focusing electrode. The shield cup 46 has three apertures 50 through its base 48, each aligned with one of the beam paths 24. The shield cup also has a plurality of bulb spacers 52 attached to and extending from its open end.

In operation, the electron gun 10 is designed to have its main focus field established between the first and second accelerating and focusing electrodes 20 and 22. To this end a novel resistive lens structure 54 is disposed between these electrodes.

Figure 3:
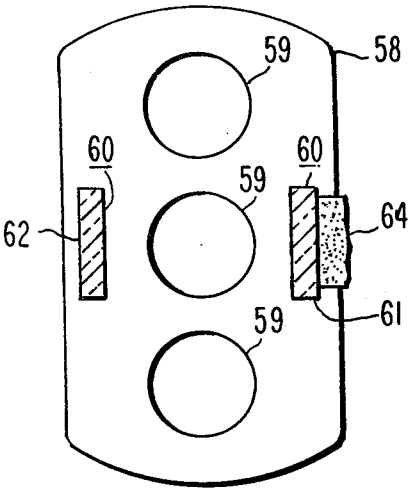
FIG. 3 is a section view taken along line 3—3 of FIG. 1.

The resistive lens structure 54 comprises a pair of end electrode plates 56 and a plurality, e.g., six, intermediate electrode plates 58. As shown in FIG. 3, each intermediate plate 58 is provided with three in-line apertures 59, each of which is aligned with one of the beam paths 24. The end plates 56 have corresponding aligned apertures. The eight plates 56, 58 are alternately stacked with spacer blocks 60. A pair of the spacer blocks 60 are disposed between any two of the adjacent plates 56, 58. Each pair of spacer blocks 60 are disposed on opposite sides of the central one of the apertures 59 and adjacent to an outer edge of an intermediate plate 58. At least one block of each pair of spacer blocks 60 comprises a resistive block 61 as hereinafter described. The other block of the pair of spacer blocks 60 may comprise either a resistive block 61 or an insulator block 62.

The insulator blocks 62 may be made of any insulating material suitable for assembly with the electrode plates and compatible with conventional electron tube thermal and vacuum processing. Conventional ceramics, such as high grade alumina, are preferred. The resistive blocks 61 preferably comprise insulator blocks 62 having on a surface thereof a coating 64 of a suitable high resistance material.

Figure 4:
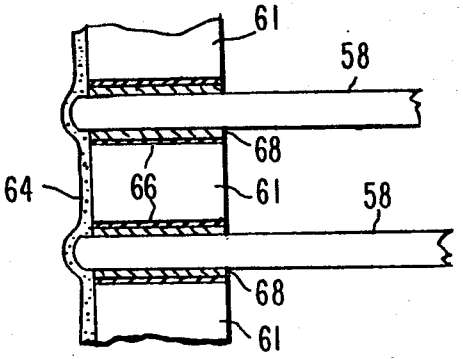
FIG. 4 is an enlarged view of a portion of FIG. 1.

As shown in FIGS. 1 and 4, the high resistance coating 64 is disposed along one side of the stack of plates 56, 58 and spacer blocks 60. As such, the high resistance coating 64 contacts an edge of each of the intermediate plates 58 and terminates in contact with the two end plates 56, thus forming a continuous high resistance electrical path between the two end plates 56. The spacer blocks 60 on which the resistive coating 64 is disposed thus function as resistive blocks 61.

When appropriate voltages are applied to the first and second accelerating and focusing electrodes 20 and 24, a current flows through the high resistance coating 64 causing a voltage drop therealong so as to establish a different potential on each of the plates 56 and 58. Such different voltages provide a voltage gradient which in turn produces the desired extended lens between the first and second accelerating and focusing electrodes 20 and 22.

As shown in FIG. 4, each of the resistive blocks 61 is provided with a metalized coating 66 on a pair of opposite surfaces thereof. The resistive blocks 61 can thereby be bonded to the plates 56, 58 by a suitable braze joint 68. The insulator blocks 62 are similarly metalized and brazed.

Figure 5:
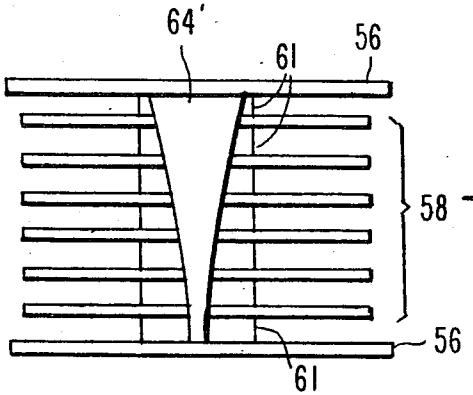
FIG. 5 is a plan view of a modification of the novel resistive lens structure.

FIG. 5 illustrates a modification of the novel resistive lens 54 in which a resistive coating 64' is of nonuniform cross-section, e.g., tapered in width, along the stack of electrode plates 56, 58 and resistive blocks 61. Such tapering results in a grading of the resistivity of the lens structure thereby resulting in a gradation of the potential profile along the lens structure. Various shapes of the resistive coating, including that of uniform width, may be provided to obtain various desired potential profiles.

Various dimensional relationships, resistance values and materials may be used in fabricating the resistive lens structure 54. Choice of these parameters will depend upon the particular electron gun structure and the equipment for which it is intended. Generally speaking, it is usually desirable to operate the voltage bleeder provided by the high resistance coating 64 with a bleeder current of from 5–10 microamps and with a power dissipation of 0.5 watt or less. Typical voltage gradients employed are usually in the range of $2.5–4.0\times10^4$ volts per centimeter.

Choice of materials for the plate electrodes 56, 58 and for the spacer blocks 60 are not critical but should be selected so as to provide a reasonable thermal expansion match between the electrodes and spacer blocks. This will avoid shifting of parts and breaking continuity of the resistive coating 64. Materials which have been found to be suitable for the electrode plates include molybdenum, copper-clad stainless steel, and platinum coated alumina ceramic. Materials which have been found to be suitable for the spacer blocks include alumina and magnesium silicate ceramics.

Alumina spacer blocks 60 have been suitably metalized with conventional titanium-tungsten metalized coatings and brazed to molybdenum electrodes with conventional silver-copper solder.

In one example of the novel resistive lens structure 54, the electrode plates 56, 58 were made of 10 mil (0.254 mm) thick molybdenum to which a strike of nickel was applied to promote brazability. The spacer blocks 60 were Ti-W metalized alumina 40 mils (1.016 mm) square and 200 mils (5.08 mm) long. Use of two end plates 56, six intermediate plates 58 and seven pair of spacer blocks 60 produced a lens structure 360 mils (9.144 mm) in length. The resistive coating 64 for this lens structure was provided by a ½ micron thick cermet layer having a resistance from plate to plate of approximately $10^9$ ohms.

In another embodiment, the electrode plates 56, 58 were platinum coated alumina, and the spacer blocks 60 were Ti-W metalized alumina. The resistive coating 64 comprised a glaze layer about 2 mils (0.051 mm) thick.

Neither the shape of the spacer blocks 60 nor their position on the electrode plates 56, 58 is critical. Each pair of spacer blocks could, for example, comprise a single rectangular annulus, with a resistive coating being applied on one or more of the legs thereof.

Both cermet materials is described in U.S. Pat. No. 4,010,312 to Pinch et al and glaze material as described in U.S. Pat. No. 4,091,144 to Dresner et al have been found suitable for use as the high resistance coating 64. Adjustment of resistivity as taught in these two patents can be practiced in order to obtain the desired overall resistance for the particular electron gun into which the resistive lens structure is incorporated. To this end the Pinch et al and Dresner et al patents are incorporated herein by reference for purpose of their disclosures.

What is claimed is:

1. An electron gun comprising:

(a) first and second accelerating and focusing electrodes fixedly mounted on a plurality of elongated insulator support rods disposed alongside said electrodes, and (b) a resistive lens structure disposed between and electrically connected to said accelerating and focusing electrodes, said lens structure comprising:

(1) a plurality of apertured electrode plates which are mutually spaced with their apertures sufficiently aligned to permit passage of an electron beam along a path therethrough, and, which when impressed with mutually different voltages, established an extended electron beam focusing lens between said first and second accelerating and focusing electrodes, and (2) a plurality of resistive spacer blocks alternately stacked with said electrode plates, there being at least one of said resistive blocks disposed between and in contact with each pair of adjacent electrode plates, whereby a high resistance continuity is provided from electrode plate to electrode plate along the stack of electrode plates and resistive blocks from one end of said stack to the other, and (c) wherein said first and second accelerating and focusing electrodes comprise means for applying different electrical voltages to the ends of said stack whereby current flows through said stack thereby creating said mutually different voltages on each of said electrode plates, thereby establishing said extended electron beam focusing lens.

2. The electron gun of claim 1 wherein said resistive blocks comprise insulator blocks having a resistive coating along one surface thereof.

3. The electron gun of claim 2 wherein said resistive lens structure comprises a resistive coating disposed along a surface of said stack which includes surface portions of each of said stacked electrodes and blocks.

4. The electron gun of claim 3 wherein said coating is applied after said electrodes and blocks are stacked together.

5. The electron gun of claim 3 wherein said resistive coating is of nonuniform cross-section in the direction along said stack whereby the resistivity of said lens structure is graded.

6. The electron gun of claim 1 wherein said resistive blocks have metalized coatings on surface portions thereof which are brazed to said electrodes on either side thereof whereby to bond said alternately stacked electrodes and resistive blocks into an integral subassembly.

7. The electron gun of claim 2 further including a plurality of insulator spacer blocks, there being both an insulator spacer block and a resistive spacer block disposed between any adjacent two of said apertured electrodes.

8. The electron gun of claim 7 wherein each of said apertured electrode plates has three in-line apertures therein and wherein an insulator spacer block disposed on one side of the central one of said three apertures of at least one of said electrode plates and a resistive spacer block disposed on the opposite side thereof.

* * * * *

UNITED STATES PATENT AND TRADEMARK OFFICE

CERTIFICATE OF CORRECTION

PATENT NO. : 4,370,594

DATED : January 25, 1983

INVENTOR(S) : Philip Kuznetzoff

It is certified that error appears in the above—identified patent and that said Letters Patent is hereby corrected as shown below: On the title page Please correct the spelling of the inventor's name to be --Kuznetzoff--.

Signed and Sealed this

*Twenty-fourth* Day of *May 1983*

[SEAL]

*Attest:*

DONALD J. QUIGG

*Attesting Officer*

*Acting Commissioner of Patents and Trademarks*